US007976438B1

(12) United States Patent
Hsu

(10) Patent No.: US 7,976,438 B1
(45) Date of Patent: Jul. 12, 2011

(54) JUMP ROPE GRIP ASSEMBLY HAVING ADJUSTABLE WEIGHT AND NUMBER COUNTING FUNCTION

(76) Inventor: Chi-Kun Hsu, Chang Hua Hsien (TW)

( * ) Notice: Subject to any disclaimer, the term of this patent is extended or adjusted under 35 U.S.C. 154(b) by 0 days.

(21) Appl. No.: 12/787,441

(22) Filed: May 26, 2010

(51) Int. Cl.
*A63B 21/00* (2006.01)

(52) U.S. Cl. ..... 482/81; 482/82

(58) Field of Classification Search ..... 482/482, 482/80, 81, 91, 110; 601/11–113
See application file for complete search history.

(56) References Cited

U.S. PATENT DOCUMENTS 4,749,183 A * 6/1988 Cho ..... 482/82
4,875,675 A * 10/1989 Arad et al. ..... 482/81
5,895,341 A * 4/1999 Jones ..... 482/81
7,621,853 B2 * 11/2009 LaTour ..... 482/81

* cited by examiner

*Primary Examiner* — Jerome W Donnelly
(74) *Attorney, Agent, or Firm* — Alan Kamrath; Kamrath & Associates PA

(57) ABSTRACT

A grip assembly for a jump rope includes a grip body having a first end formed with an open casing and a second end formed with a receiving space, a counter mounted in the casing, a cover mounted on the casing and abutting the counter to locate the counter between the casing and the cover, a pivot head rotatably mounted on the casing and connected with the counter to drive the counter, and a weight member mounted in the receiving space of the grip body. Thus, the counter can count and indicate the jump number of the jump rope so that the user can know the jump number exactly. In addition, the weight member provides a damping force to the user' arms so as to exercise the user's arms.

3 Claims, 7 Drawing Sheets

JUMP ROPE GRIP ASSEMBLY HAVING ADJUSTABLE WEIGHT AND NUMBER COUNTING FUNCTION

BACKGROUND OF THE INVENTION

1. Field of the Invention

The present invention relates to a grip assembly and, more particularly, to a grip assembly for a jump rope.

2. Description of the Related Art

A conventional jump rope comprises a rope and two grips mounted on two opposite ends of the rope. Thus, a user's two hands can hold the two grips to revolve the rope in circles so as to achieve an exercising effect. However, the user doesn't know the jump number exactly, so that he/she cannot precisely evaluate the calories of consumption during the jumping process, thereby limiting the exercising effect of the jump rope. In addition, the conventional jump rope only has a single function, thereby limiting the versatility of the jump rope.

BRIEF SUMMARY OF THE INVENTION

In accordance with the present invention, there is provided a grip assembly for a jump rope, comprising a grip body having a first end formed with an open casing and a second end formed with a receiving space, a counter mounted in the casing of the grip body, a cover mounted on the casing of the grip body and abutting the counter to locate the counter between the casing of the grip body and the cover, a pivot head rotatably mounted on the casing of the grip body and connected with the counter to drive the counter, and a weight member mounted in the receiving space of the grip body.

The casing of the grip body has an inner portion formed with a receiving recess to receive the counter. The casing of the grip body has an end face formed with a passage connected to the receiving recess. The receiving space of the grip body has a distal end formed with an inner threaded portion. The cover has an end face formed with an opening facing the passage of the casing. The counter is mounted in the receiving recess of the casing. The counter has a side provided with a counting knob which is rotatably mounted on the counter. The pivot head has a first end provided with a support rod extended through and rotatably mounted between the casing of the grip body and the cover. The support rod of the pivot head extends through the passage of the casing and the opening of the cover. The support rod of the pivot head has a distal end formed with an enlarged limit portion abutting the counting knob of the counter to drive and rotate the counting knob of the counter by rotation of the pivot head. The limit portion of the pivot head is limited in the receiving recess of the casing and has an end face formed with a limit recess abutting the counting knob of the counter. The pivot head has a second end formed with two rope channels and a connecting hole located between and connected to the two rope channels. The weight member has an end portion formed with an outer threaded portion screwed into the inner threaded portion of the grip body to lock the weight member in the grip body.

The cover has a top formed with a peep slot and a through hole. The counter has a top provided with a plurality of number wheels which are rotatably mounted on the counter and provided with a reset button which is retractably mounted on the counter. The number wheels of the counter protrudes outward from the peep slot of the cover. The reset button of the counter protrudes outward from the through hole of the cover. The pivot head protrudes outward from the casing of the grip body and the cover.

The weight member is fully received in the receiving space of the grip body. The weight member has different sizes and weights. The weight member has a threaded rod extended from the outer threaded portion for mounting a plurality of counterbalances. The threaded rod of the weight member has a diameter smaller than that of the outer threaded portion of the weight member. Each of the counterbalances has a diameter flush with that of the outer threaded portion of the weight member. Each of the counterbalances has an inner wall formed with a screw bore screwed onto the threaded rod of the weight member.

The primary objective of the present invention is to provide a jump rope grip assembly having adjustable weight and a number counting function.

According to the primary advantage of the present invention, the counter can count and indicate the jump number of the jump rope so that the user can know the jump number exactly and can precisely evaluate the calories of consumption during the jumping process so as to enhance the exercising effect of the jump rope.

According to another advantage of the present invention, the weight member provides a damping force to the user' arms so as to exercise the user's arms, thereby enhancing the versatility of the jump rope.

According to a further advantage of the present invention, the weight of the weight member can be adjusted by the counterbalances so as to fit the requirements of different users.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
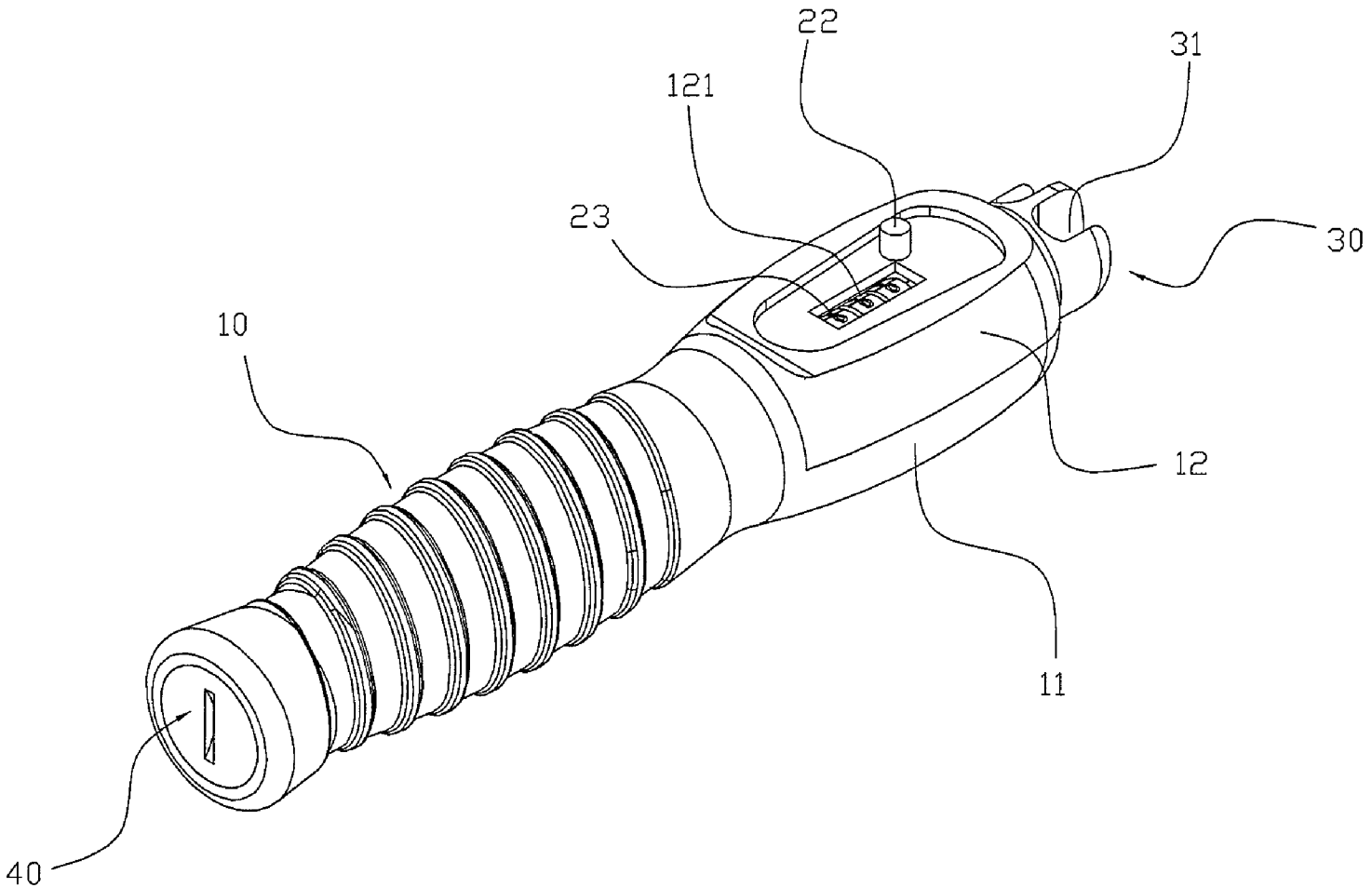
FIG. 1 is a perspective view of a grip assembly for a jump rope in accordance with the preferred embodiment of the present invention.
Figures 2, 3:
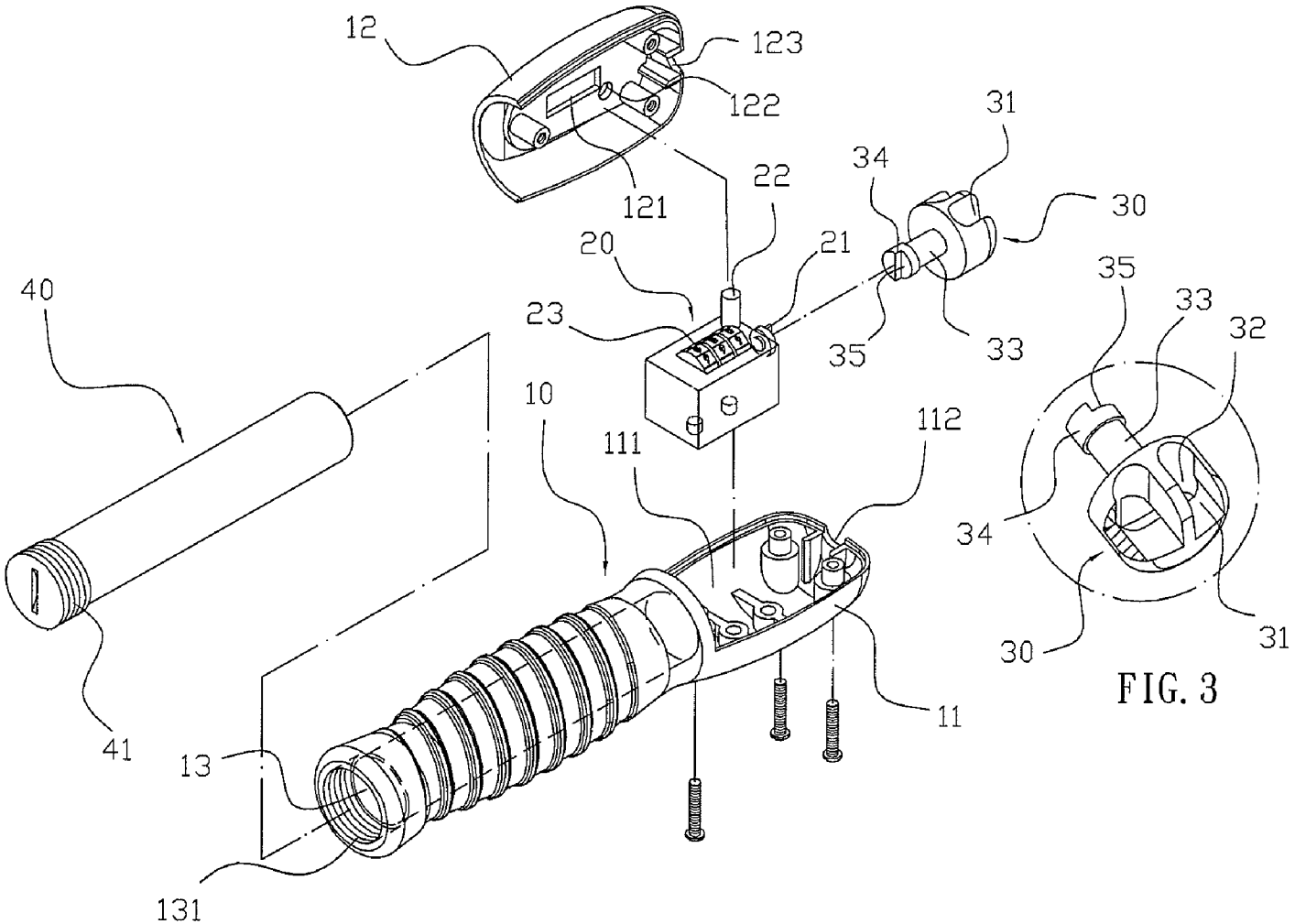
FIG. 2 is an exploded perspective view of the grip assembly for a jump rope as shown in FIG. 1.
FIG. 3 is a locally perspective enlarged view of a pivot head of the grip assembly for a jump rope as shown in FIG. 2.
Figure 4:
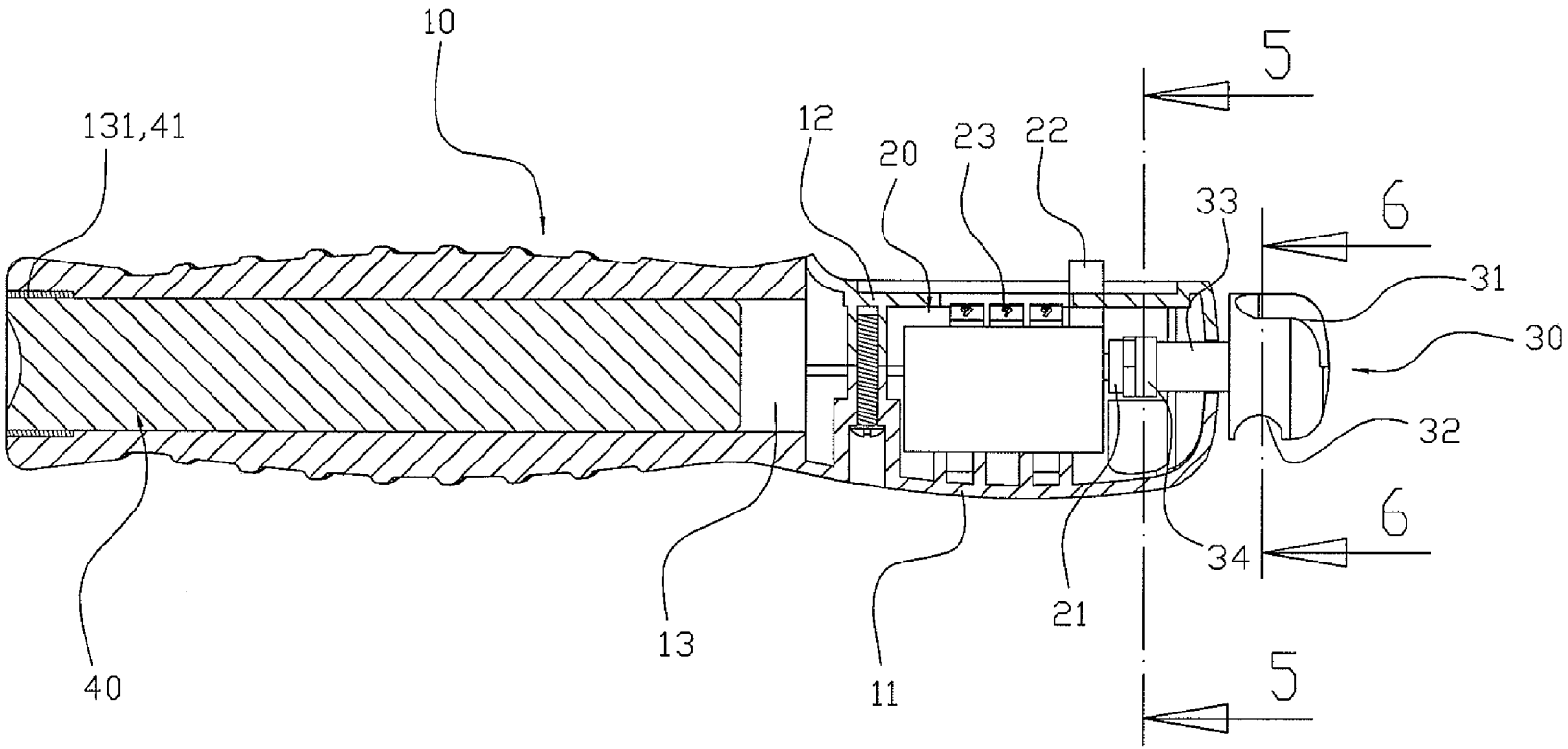
FIG. 4 is a front cross-sectional view of the grip assembly for a jump rope as shown in FIG. 1.
Figure 5:
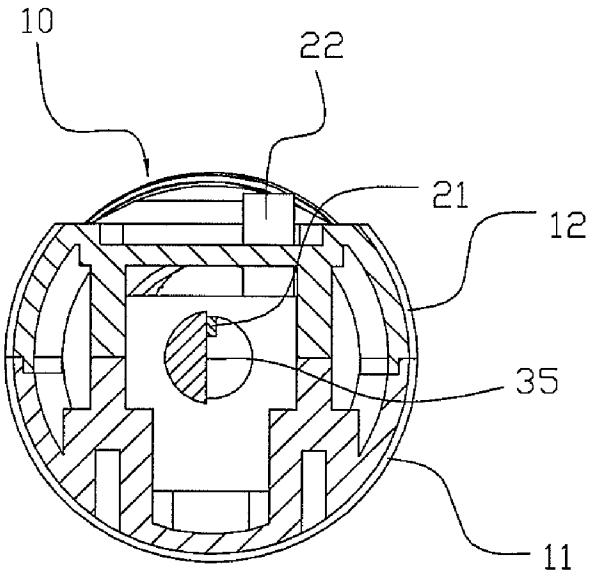
FIG. 5 is a side cross-sectional view of the grip assembly for a jump rope taken along line 5-5 as shown in FIG. 4.

Referring to the drawings and initially to FIGS. 1-6, a grip assembly for a jump rope in accordance with the preferred embodiment of the present invention comprises a grip body 10 having a first end formed with an open casing 11 and a second end formed with a receiving space 13, a counter 20 mounted in the casing 11 of the grip body 10, a cover 12 mounted on the casing 11 of the grip body 10 and abutting the counter 20 to locate the counter 20 between the casing 11 of the grip body 10 and the cover 12, a pivot head 30 rotatably mounted on the casing 11 of the grip body 10 and connected with the counter 20 to drive the counter 20, and a weight member 40 mounted in the receiving space 13 of the grip body 10.

The casing 11 of the grip body 10 has an inner portion formed with a receiving recess 111 to receive the counter 20. The casing 11 of the grip body 10 has an end face formed with a passage 112 connected to the receiving recess 111. The receiving space 13 of the grip body 10 has a distal end formed with an inner threaded portion 131.

The cover 12 has a top formed with a peep slot 121 and a through hole 122. The cover 12 has an end face formed with an opening 123 facing the passage 112 of the casing 11.

The counter 20 is mounted in the receiving recess 111 of the casing 11. The counter 20 has a side provided with a counting knob 21 which is rotatably mounted on the counter 20. The counter 20 has a top provided with a plurality of number wheels 23 which are rotatably mounted on the counter 20 and provided with a reset button 22 which is retractably mounted on the counter 20. The number wheels 23 of the counter 20 protrudes outward from the peep slot 121 of the cover 12. The reset button 22 of the counter 20 protrudes outward from the through hole 122 of the cover 12.

The pivot head 30 protrudes outward from the casing 11 of the grip body 10 and the cover 12. The pivot head 30 has a first end provided with a support rod 33 extended through and rotatably mounted between the casing 11 of the grip body 10 and the cover 12. The support rod 33 of the pivot head 30 extends through the passage 112 of the casing 11 and the opening 123 of the cover 12. The support rod 33 of the pivot head 30 has a distal end formed with an enlarged limit portion 34 abutting the counting knob 21 of the counter 20 to drive and rotate the counting knob 21 of the counter 20 by rotation of the pivot head 30. The limit portion 34 of the pivot head 30 is limited in the receiving recess 111 of the casing 11 and has an end face formed with a limit recess 35 abutting the counting knob 21 of the counter 20. The pivot head 30 has a second end formed with two rope channels 31 and a connecting hole 32 located between and connected to the two rope channels 31.

The weight member 40 is fully received in the receiving space 13 of the grip body 10 and has an end portion formed with an outer threaded portion 41 screwed into the inner threaded portion 131 of the grip body 10 to lock the weight member 40 in the grip body 10.

Figure 6:
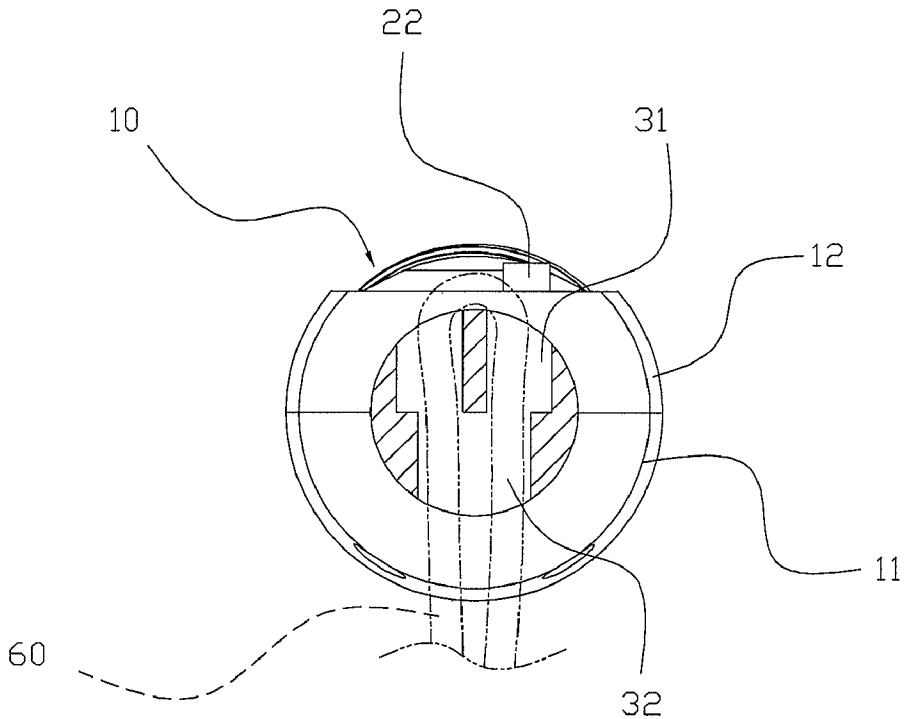
FIG. 6 is a side cross-sectional view of the grip assembly for a jump rope taken along line 6-6 as shown in FIG. 4.
Figure 7:
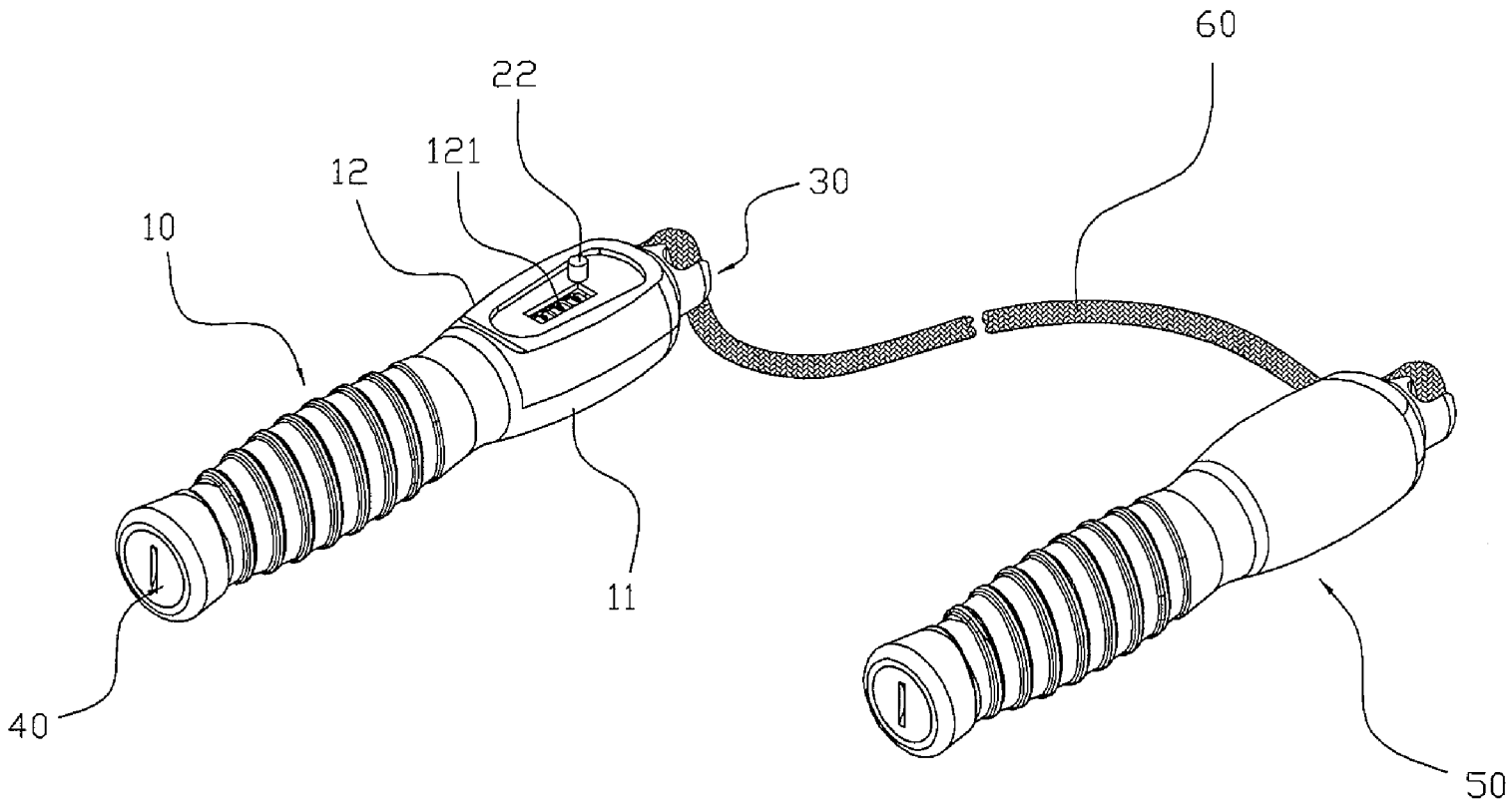
FIG. 7 is a perspective view showing usage of the grip assembly for a jump rope in accordance with the preferred embodiment of the present invention.

In operation, referring to FIGS. 6 and 7 with reference to FIGS. 1-5, the grip assembly co-operates with a second grip assembly 50 to hold a jump rope 60. The second grip assembly 50 does not have the counter 20. The jump rope 60 has two ends each mounted on the pivot head 30 of each of the grip assembly and the second grip assembly 50 so that when the jump rope 60 is moved, the pivot head 30 of each of the grip assembly and the second grip assembly 50 is also rotated by movement of the jump rope 60. Each of the two ends of the jump rope 60 are extended through the two rope channels 31 and the connecting hole 32 of the pivot head 30. In such a manner, when the jump rope 60 is rotated in circles successively, the pivot head 30 of each of the grip assembly and the second grip assembly 50 is rotated to rotate the support rod 33 which rotates the limit portion 34 which rotates the counting knob 21 of the counter 20, so that the counter 20 is operated by rotation of the counting knob 21 to count the number of rotation of the pivot head 30 so as to count the jump number of the jump rope 60. At this time, the number wheels 23 of the counter 20 shows the jump number of the jump rope 60, and the reset button 22 can be used to reset the number wheels 23 of the counter 20. At the same time, the weight member 40 provides a damping force to a user' arms so as to exercise the user's arms.

Figures 8, 9, 10:
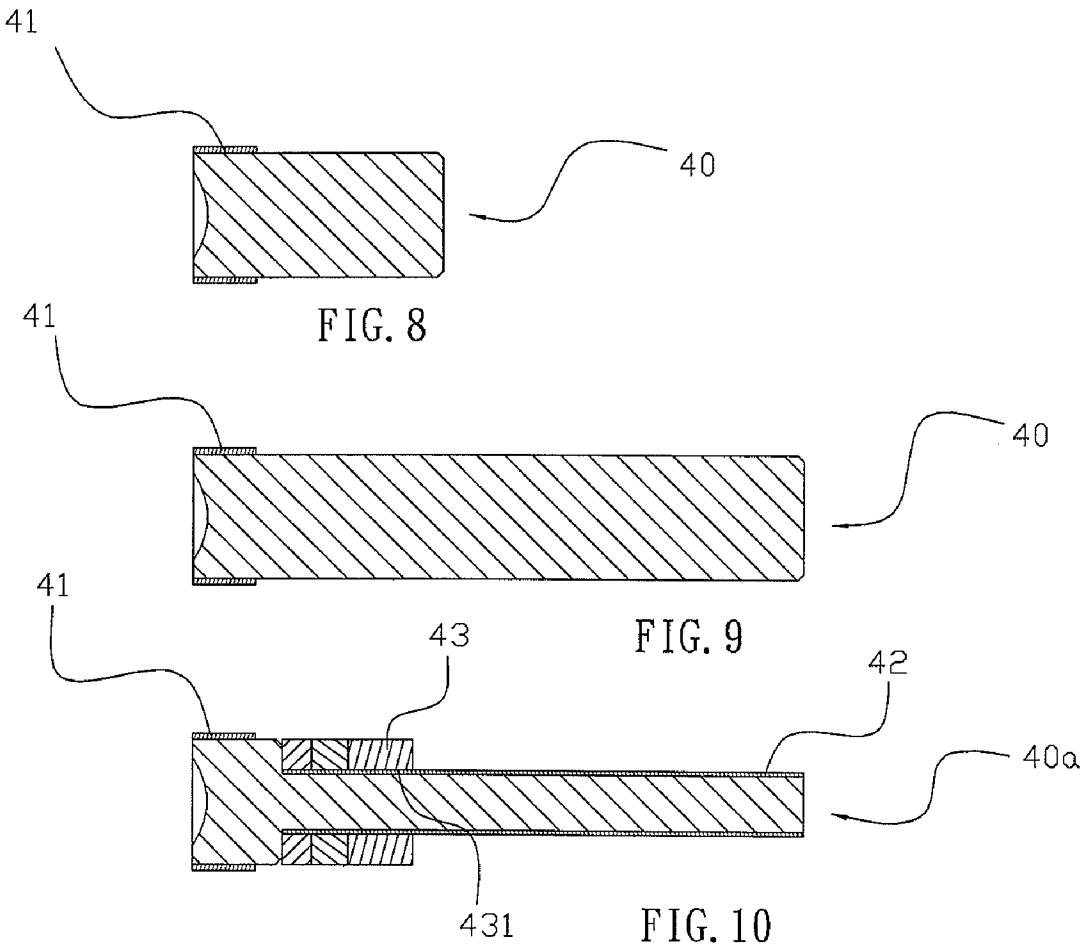
FIG. 8 is a front cross-sectional view of a weight member of the grip assembly for a jump rope in accordance with another preferred embodiment of the present invention.
FIG. 9 is a front cross-sectional view of a weight member of the grip assembly for a jump rope in accordance with another preferred embodiment of the present invention.
FIG. 10 is a front cross-sectional view of a weight member of the grip assembly for a jump rope in accordance with another preferred embodiment of the present invention.

As shown in FIGS. 8 and 9, the weight member 40 has different sizes and weights.

As shown in FIG. 10, the weight member 40*a* has a threaded rod 42 extended from the outer threaded portion 41 for mounting a plurality of counterbalances 43. The threaded rod 42 of the weight member 40*a* has a diameter smaller than that of the outer threaded portion 41 of the weight member 40*a*. Each of the counterbalances 43 has a diameter flush with that of the outer threaded portion 41 of the weight member 40*a*. Each of the counterbalances 43 has an inner wall formed with a screw bore 431 screwed onto the threaded rod 42 of the weight member 40*a*. In such a manner, the weight of the weight member 40*a* can be adjusted by the counterbalances 43.

Accordingly, the counter 20 can count and indicate the jump number of the jump rope 60 so that the user can know the jump number exactly and can precisely evaluate the calories of consumption during the jumping process so as to enhance the exercising effect of the jump rope 60. In addition, the weight member 40 provides a damping force to the user' arms so as to exercise the user's arms, thereby enhancing the versatility of the jump rope 60. Further, the weight of the weight member 40*a* can be adjusted by the counterbalances 43 so as to fit the requirements of different users.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A grip assembly for a jump rope, comprising:

a grip body having a first end formed with an open casing and a second end formed with a receiving space;

a counter mounted in the casing of the grip body;

a cover mounted on the casing of the grip body and abutting the counter to locate the counter between the casing of the grip body and the cover;

a pivot head rotatably mounted on the casing of the grip body and connected with the counter to drive the counter; and a weight member mounted in the receiving space of the grip body;

wherein the casing of the grip body has an inner portion formed with a receiving recess to receive the counter;

the casing of the grip body has an end face formed with a passage connected to the receiving recess;

the receiving space of the grip body has a distal end formed with an inner threaded portion;

the cover has an end face formed with an opening facing the passage of the casing;

the counter is mounted in the receiving recess of the casing;

the counter has a side provided with a counting knob which is rotatably mounted on the counter;

the pivot head has a first end provided with a support rod extended through and rotatably mounted between the casing of the grip body and the cover;

the support rod of the pivot head extends through the passage of the casing and the opening of the cover;

the support rod of the pivot head has a distal end formed with an enlarged limit portion abutting the counting knob of the counter to drive and rotate the counting knob of the counter by rotation of the pivot head;

the limit portion of the pivot head is limited in the receiving recess of the casing and has an end face formed with a limit recess abutting the counting knob of the counter;

the pivot head has a second end formed with two rope channels and a connecting hole located between and connected to the two rope channels;

the weight member has an end portion formed with an outer threaded portion screwed into the inner threaded portion of the grip body to lock the weight member in the grip body.

2. The grip assembly for a jump rope of claim 1, wherein the cover has a top formed with a peep slot and a through hole;

the counter has a top provided with a plurality of number wheels which are rotatably mounted on the counter and provided with a reset button which is retractably mounted on the counter;

the number wheels of the counter protrudes outward from the peep slot of the cover;

the reset button of the counter protrudes outward from the through hole of the cover;

the pivot head protrudes outward from the casing of the grip body and the cover.

3. The grip assembly for a jump rope of claim 1, wherein the weight member is fully received in the receiving space of the grip body;

the weight member has different sizes and weights;

the weight member has a threaded rod extended from the outer threaded portion for mounting a plurality of counterbalances;

the threaded rod of the weight member has a diameter smaller than that of the outer threaded portion of the weight member;

each of the counterbalances has a diameter flush with that of the outer threaded portion of the weight member;

each of the counterbalances has an inner wall formed with a screw bore screwed onto the threaded rod of the weight member.

* * * * *